US007311032B2

(12) United States Patent
Murello

(10) Patent No.: US 7,311,032 B2
(45) Date of Patent: Dec. 25, 2007

(54) FIREARMS WITH GAS PRESSURE LOADING MECHANISMS

(75) Inventor: Johannes Murello, Deiblingen (DE)

(73) Assignee: Heckler & Koch, GmbH, Oberndorf/Neckar (DE)

( * ) Notice: Subject to any disclaimer, the term of this patent is extended or adjusted under 35 U.S.C. 154(b) by 298 days.

(21) Appl. No.: 11/072,155

(22) Filed: Mar. 4, 2005

(65) Prior Publication Data

US 2005/0235817 A1 Oct. 27, 2005

Related U.S. Application Data

(63) Continuation-in-part of application No. 10/956,562, filed on Oct. 1, 2004, now abandoned, and a continuation of application No. PCT/EP03/09493, filed on Aug. 27, 2003, and a continuation of application No. PCT/EP03/09483, filed on Aug. 27, 2003, which is a continuation of application No. PCT/EP03/09490, filed on Aug. 27, 2003.

(30) Foreign Application Priority Data

Sep. 4, 2002 (DE) ..... 102 40 886
Sep. 4, 2002 (DE) ..... 102 40 889
Sep. 4, 2002 (DE) ..... 102 40 891

(51) Int. Cl.
*F41A 5/24* (2006.01)

(52) U.S. Cl. ..... 89/191.01

(58) Field of Classification Search ..... 89/191.01, 89/191.02, 192, 193
See application file for complete search history.

(56) References Cited

U.S. PATENT DOCUMENTS 813,694 A * 2/1906 Fidjeland ..... 89/185
2,031,305 A 2/1936 End et al.
2,267,501 A 12/1941 Holek
2,582,989 A * 1/1952 Harvey ..... 89/193

(Continued)

FOREIGN PATENT DOCUMENTS

AT 393 028 B 7/1991

(Continued)

OTHER PUBLICATIONS

English Language Translation of International Preliminary Examination Report for PCT Application Serial No. PCT/EP2003/009493, 5 pages.

(Continued)

*Primary Examiner*—Stephen M. Johnson
(74) *Attorney, Agent, or Firm*—Hanley, Flight & Zimmerman, LLC

(57) ABSTRACT

Firearms employing gas pressure loading mechanisms are disclosed. An example firearm includes a single force receiving component containing a gas cylinder, and a barrel in communication with a cartridge chamber received in the force receiving component. The cartridge chamber is in communication with a gas withdrawal-opening and is sized to fire cartridges having a caliber of at least 15 mm. The firearm also includes a bore in communication with the gas withdrawal opening and the gas cylinder. Further, the firearm includes a locking bolt having a locked position and an unlocked position. The locking bolt engages the single force receiving component when the locking bolt is in the locked position.

15 Claims, 2 Drawing Sheets

U.S. PATENT DOCUMENTS

| | | | | | |
|---|---|---|---|---|---|
| 2,732,768 | A | | 1/1956 | Browning | |
| 2,887,013 | A | * | 5/1959 | Marsh | 89/193 |
| 3,213,558 | A | | 10/1965 | Horsrud | |
| 3,282,166 | A | * | 11/1966 | Maillard | 89/191.01 |
| 3,791,060 | A | | 2/1974 | Weaver | 42/16 |
| 3,906,651 | A | | 9/1975 | Vasemaa | 42/25 |
| 4,580,484 | A | | 4/1986 | Moore | 89/128 |
| 4,604,942 | A | | 8/1986 | Benelli | 85/185 |
| 4,635,530 | A | * | 1/1987 | Weldle | 89/159 |
| 5,834,678 | A | * | 11/1998 | Kalb | 89/187.01 |
| 5,886,281 | A | * | 3/1999 | Kirstein | 89/185 |
| 5,983,774 | A | | 11/1999 | Mihaita | 89/188 |

FOREIGN PATENT DOCUMENTS

| | | |
|---|---|---|
| DE | 374753 | 4/1923 |
| FR | 637.155 | 4/1928 |
| FR | 1.226.597 | 7/1961 |
| GB | 465112 | 4/1937 |
| GB | 649519 | 1/1951 |

OTHER PUBLICATIONS

German Language International Preliminary Examination Report for PCT Application Serial No. PCT/EP2003/009403, 6 pages.

International Search Report for PCT Application Serial No. PCT/EP2003/009493, 3 pages.

* cited by examiner

FIREARMS WITH GAS PRESSURE LOADING MECHANISMS

RELATED APPLICATION

This patent arises from a U.S. patent application which is (a) a continuation of International Patent Application Ser. No. PCT/EP2003/009493, filed Aug. 27, 2003, (b) a continuation of International Patent Application Ser. No. PCT/EP2003/009483, filed Aug. 27, 2003, and (c) a continuation-in-part of U.S. patent application Ser. No. 10/956,562, filed on Oct. 1, 2004. U.S. patent application Ser. No. 10/956,562 is a continuation of International Patent Application Ser. Number PCT/EP03/09490, which was filed on Aug. 27, 2003. International Patent Application Ser. No. PCT/EP2003/009493, International Patent Application Serial No. PCT/EP2003/009483, International Patent Application Ser. Number PCT/EP03/09490, and U.S. patent application Ser. No. 10/956,562 are all hereby incorporated herein by reference in the entirety.

FIELD OF THE DISCLOSURE

This disclosure relates generally to handheld firearms, and more particularly, to firearms employing gas pressure loading mechanisms.

BACKGROUND

Throughout this patent, position designations such as "above," "below," "top" "forward," "rear," etc. are referenced to a firearm held in a normal firing position (i.e., pointed away from the shooter in a generally horizontal direction).

As used in this patent, "large caliber" denotes a rifle with a caliber or greatest case diameter of the cartridge of more than 15 mm. With large caliber rifles, a heavy projectile (for example, a bullet, an adapter base projectile, a charge of shot, a gas body or the like) is shot at a rather low speed compared with other, small caliber high-performance rifles. Consequently, the gas pressure is also comparatively low, particularly in the front region of the barrel.

In the case of a large caliber, gas-operated rifle whose cartridge diameter is above 15 mm, the breech is large and long, and hence heavy. As a result, the force required to reload it is also large. Since, as already mentioned, the gas pressure of such a rifle is low, the action area of the gas piston must be great. Accordingly the quantity of gas which is depleted from the barrel during firing is also large. For this reason, recoil-operated guns have usually been preferred. However, recoil-operated guns have the disadvantage of being particularly sensitive to the type of ammunition used.

In case of large caliber weapons, a central anchoring element upon which all occurring forces are supposed to impinge has recently been provided to save weight. To a large extent, when such a central anchoring element is employed, the weapon case can be designed in the lightest plastic style, since the weapon case is subjected to little stress because the stresses are largely absorbed by the central anchoring element. A gas piston which usually interacts with the gas cylinder requires an additional point of power input at the tapping point of the barrel. Consequently, it is rather heavy in construction.

Large caliber rifles are disadvantaged in that the rifle is built rather long, if it is constructed as an enlarged, normal caliber rifle.

DETAILED DESCRIPTION

Figure 1:
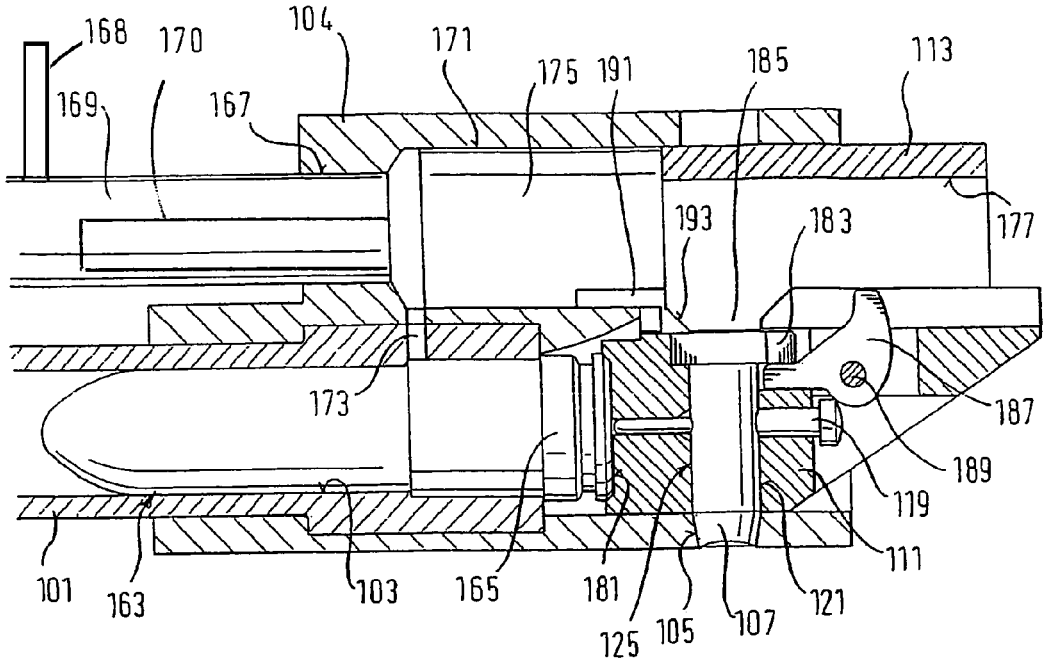
FIG. 1 is a longitudinal cross-sectional view through a rear barrel end of an example force receiving part and breech.
Figure 2:
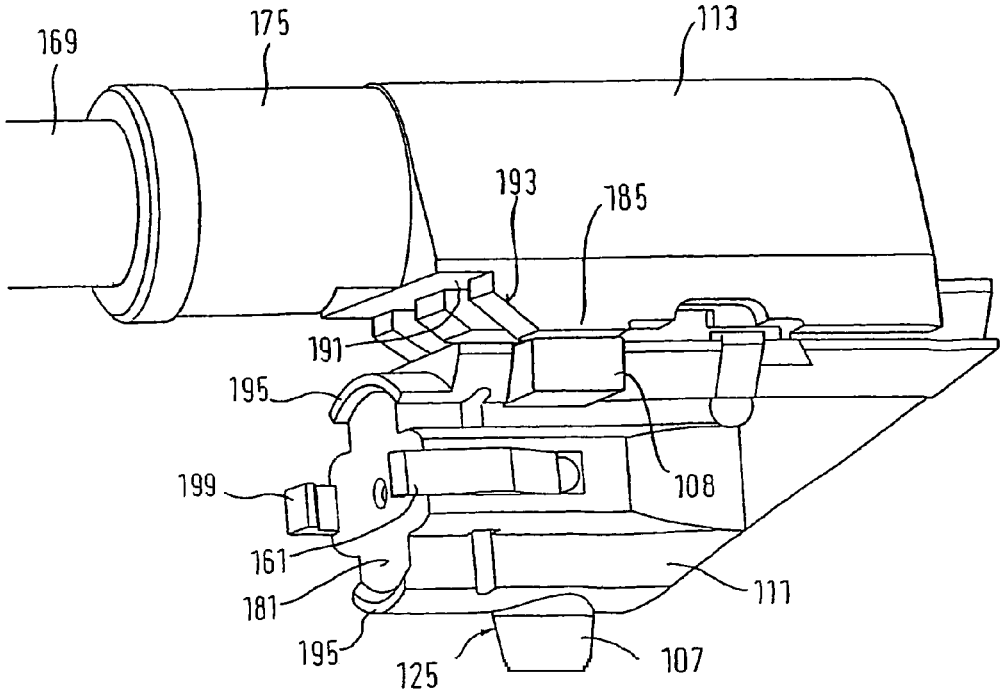
FIG. 2 is a perspective view of the example breech of FIG. 1.

FIGS. 1-4 illustrate the breech of an example large caliber semi-automatic rifle. The example rifle of FIGS. 1-4 uses shell cartridges that have an overall length of about 90 mm, a case length less than 30 mm, and a caliber of 20 mm. FIGS. 1-4 illustrate the same weapon. The same reference numerals are used for the same structures throughout the figures.

The illustrated rifle has a barrel (101) which is inserted into a force receiving part (104). The rear end of the barrel (101) defines a cartridge chamber (103). The cartridge chamber (103) holds the cartridge case (165) of a cartridge (163).

The force receiving part (104) forms a central anchoring element. Thus, in addition to the barrel (101), a case, a sighting electronic unit, a sling carrier and/or an attachment (e.g., a grenade launcher, an automatic pistol, etc.) can be fastened to the force receiving part (104).

The force receiving part (104) defines an upper bore hole above the bore hole that receives the barrel (101). This upper bore hole includes two portions, namely, a front bore hole (167) and a rear bore hole (171). The front bore hole (167) has a smaller diameter than the rear bore hole (171). The front bore hole (167) is constructed to receive a breech-closing spring pipe or tube (169). The front bore hole (167)joins into the rear bore hole (171), which forms a gas cylinder. The transition between the two bore holes (167, 171) is beveled. This transition is connected to the barrel (101) by a gas intake bore hole (173). The gas intake bore hole (173) extends at a right angle to the barrel (101) and joins into the barrel (101) at the end of the cartridge chamber (103).

A pipe or tube is placed in the two bore holes (167, 171). The pipe includes two cylindrical pipe sections with different diameters, namely, a breech-closing spring pipe (169) and a gas piston (175). The breech-closing spring pipe (169) is adjustable, and acts as a seal in the bore hole (167). The gas piston (175) is adjustable, and acts as a seal in the gas cylinder (171). The recess between the two pipe sections (169), (175) forms the active area of the gas piston (175). The gas piston (175) is extended to the rear in a single piece, namely, as a bolt head carrier (113).

The pipe (169), the gas piston (175) and the bolt head carrier (113) together comprise a movable component. This movable component defines a breech-closing spring locating bore hole (177) to the rear. The breech-closing spring locating bore hole (177) is a blind hole which is open to the rear and closed to the front. This bore hole (177) receives a breech-closing spring (not shown), which is supported behind the illustrated arrangement in the breech.

A firing lever (not shown) is coupled to the front side of the breech-closing spring pipe (169). This firing lever may be used to move the entire component (169, 175, 113) back against the force of the breech-closing spring.

When the cartridge (163) in the cartridge chamber (103) is fired, powder gases penetrate through the gas intake bore hole (173) into the gas cylinder (171). The gases press the entire movable component (169, 175, 113) to the rear against the force of the breech-closing spring via the gas piston (175).

The bolt head carrier (113) can be moved back either by hand or automatically. The bolt head carrier (113) travels a straight-line path of motion, which runs parallel to the center line of the barrel (101). Longitudinal grooves in the case, (not shown), guide the bolt head carrier (113) together with the breech-closing spring pipe (169) and gas piston (175) in the gas cylinder (171) in the force receiving part (104).

A bolt head (111) is located behind the barrel (101) and under the bolt head carrier (113). This bolt head (111) can be moved back and forth together with the bolt head carrier (113). However, the bolt head (111) cannot be moved alone. The movement distance of the bolt head (111) is longer than the length of a cartridge (163). The movement of the bolt head (111) is guided by longitudinal grooves or cross-pieces in the case.

The bolt head (111) is penetrated by a locking bolt (125). The locking bolt (125) has the shape of a vertical letter "T." The vertical beam of the locking bolt (125) passes through a vertical bore hole (121) in the bolt head (111). This vertical beam terminates below in a locking extension (107). Each of the opposite ends of the horizontal beam of the "T" defines a locking finger (108). In the middle, the horizontal beam has a coupling projection (183) extending to the rear.

Figure 3:
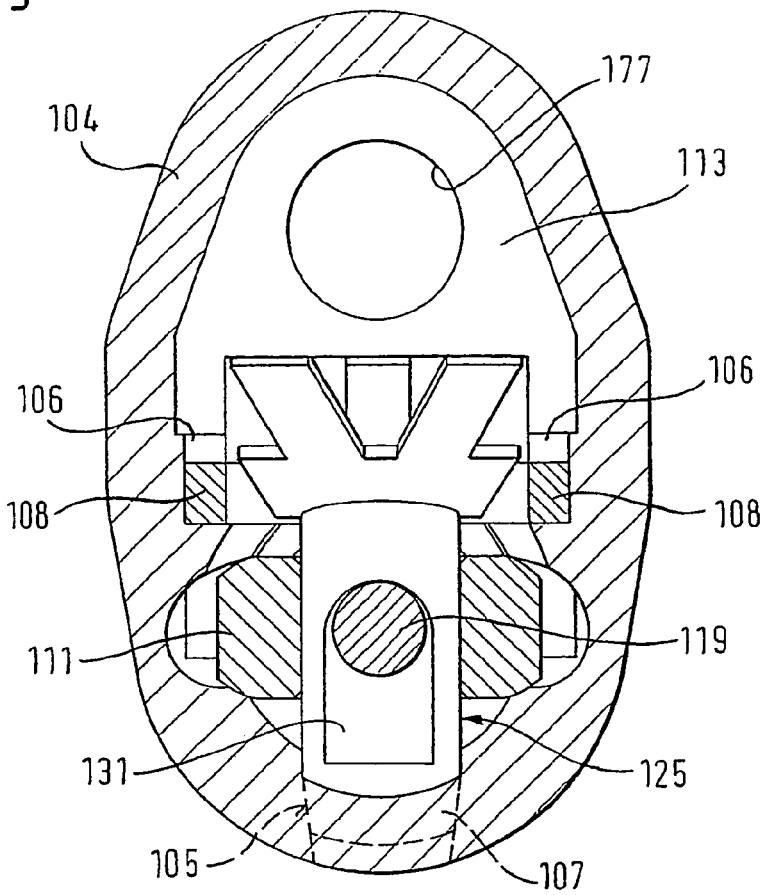
FIG. 3 is a schematic cross-sectional view through the example breech of FIG. 1.

As shown in FIG. 3, three recesses are defined in the force receiving part (104) for receiving corresponding parts of the locking bolt (125). One of the recesses is a lower, locking recess (105). The lower locking recess (105) comprises a conical bore hole. The middle of the bore hole lies on a vertical axis which passes through the center line of the barrel (101). The other two recesses are locking notches (106) symmetrically placed on opposite side of the vertical axis that passes through the locking recess (105). The locking notches (106) are seated in front of projections of the inner surface of the force receiving part (104).

When the locking bolt (125) is located in the lower position shown in FIG. 1 (i.e., the locking position), the locking extension (107) engages in the locking recess (105), and the locking fingers (108) engage in the locking notches (106). The bolt head (111) is then rigidly locked in the force receiving part (104). This is the locking position of the locking bolt (125).

When the locking bolt (125) is raised, the locking extension (107) lifts out of the locking recess (105) and the locking fingers (108) lift out of the locking notches (106). This is the unlocked position of the locking bolt (125). When the locking bolt (125) is in the unlocked position, the bolt head (111) is unlocked and can move to the rear.

A firing pin (119) passes through an oblong hole (131) in the locking bolt (125). This oblong hole (131) permits unhindered movement of the locking bolt (125) between the locked position and the unlocked position. The firing pin (119) is oriented horizontally and centrally relative to the barrel (101).

Figure 4:
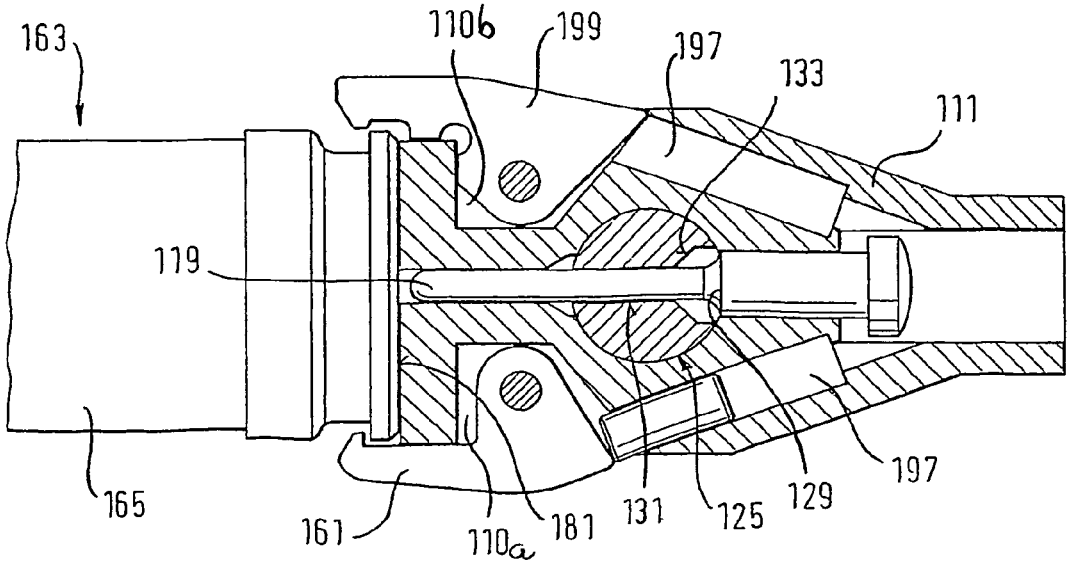
FIG. 4 is a horizontal cross-sectional view through the bolt head of FIG. 1 showing the bolt head in engagement with the rear part of a cartridge.

As can be seen in FIG. 4, the firing pin (119) has a bulge (129). The rear side of the oblong hole (131) in the locking bolt (125) has a beveled edge (133) that extends from the rear and the bottom to the top and the front. This beveled edge allows the firing pin (119) to penetrate into the locking bolt (125) from the rear when the locking bolt is in the locked position shown in the FIG. 1. However, when the locking bolt (125) moves up to its unlocked position, then the beveled edge (133) of the locking bolt (125) moves the bulge (129) of the firing pin (119) (and, thus, the firing pin (119) itself) to the rear. Consequently, the firing pin can only reach its front most position when the locking bolt (125) is in its locked position. As a result, a cartridge (163) may only be fired when the locking bolt (125) is in its locked position.

The use of the beveled edge (133) and the bulge (129) to control the position of the firing pin (119) eliminates the need for the firing pin spring required by other weapons in the prior art.

A cross shaft (189) is provided in the bolt head (111) behind the locking bolt (125). An axial tilting lever (187) is pivotably mounted on this cross shaft (189). One leg of this tilting lever (187) engages the coupling projection (183) of the locking bolt (125). The other leg of this tilting lever (187) ascends to the bottom of the bolt head carrier (113).

A descending locking projection (185) is located in front of this ascending leg of the tilting lever (187). The front side of the locking projection (185) has a beveled edge (193) that extends upward toward the top and front. This arrangement functions in the following manner. In the locked position of the breech bolt (125) (lower position), the bolt head carrier (113) is in the front most position. The locking projection (185) is seated above the locking bolt (125) and, thus, prevents the locking bolt (125) from being removed from its lowered position. The location of the tilting lever (187) in this state can be seen in FIG. 1.

Now, if the bolt head carrier (113) is moved to the rear by hand or through gas pressure, the locking projection (185) also moves to the rear, thereby freeing the locking bolt (125) for upward movement. Simultaneously, the locking projection (185) runs into the vertical leg of the tilting lever (187) and rotates it (clockwise in the drawing). As a result, the horizontal leg of the tilting lever (187) lifts the coupling projection (183) and, consequently, the locking bolt (125). The upper part of the locking bolt (125) engages in a coupling groove (191), which is constructed at the bottom side of the bolt head carrier (113) in front of the bevel (193). Simultaneously, the locking projection (185) runs over the upper leg of the tilting lever (187) and thereby keeps the tilting lever (187) tilted, so that the tilting lever (187) keeps the locking bolt (125) in the upper position, (i.e., engaged in the groove (191)). Consequently, the locking bolt (125) follows the motion of the bolt head carrier (113) to the rear. Since the locking bolt (125) remains engaged in the bolt head (111), the bolt head (111) also follows the motion of the bolt head carrier (113) to the rear. In this process, a case formation (not shown) engages the locking bolt (125) from below and prevents it from falling down.

To load and fire the next round, the bolt head carrier (113) must return to the front where the bolt head (111) contacts the rear of the barrel (101). To lock the breech, the parts (107, 108) of the locking bolt (125) must drop down into the corresponding recesses (105, 106) of the power intake part (104). This downward movement is forced by the beveled edge (193) of the locking projection (185). In particular, this beveled edge (193) cams the locking bolt (125) downward as the bolt head carrier (113) moves forward. Simultaneously, the rear side of the locking projection (185) releases the tilting lever (187) so that it can pivot upward again into the position shown in FIG. 1. When the locking block (125) moves into the position of FIG. 1, the bolt head (111) is locked. When the locking bolt (125) is located in its bottom position (see FIG. 1), the beveled edge (133) of the locking bolt (125) releases the firing pin (119) for firing of a shot. The weapon is now ready to fire, if there is a cartridge (163) in the cartridge chamber (103). (Prior to locking, as the bolt head carrier (113) moves forward, the gas piston (175) (which, in the illustrated example, is constructed in one piece with the bolt head carrier (113)) runs into the front end of the gas cylinder (171)).

In the illustrated example, the length of the cartridge case (165) is less than one third of the total return motion of the breech (111, 113). As a result, the cartridge case (165) is completely removed from the cartridge chamber (103), even before the breech (111, 113) has been appreciably slowed by the breech-closing spring. Further, the acceleration phase of the breech (111, 113) is already completed, since the barrel (101) must be practically pressure-less by the time the cartridge case (165) is completely removed.

In order to support the cartridge case (165), the breech block (181) of the bolt head (111) is provided with support extensions (195) at the top and at the bottom. Lateral support of the cartridge case (165) is more difficult to guarantee.

Referring to FIG. 4, a horizontal cross-section through the center of the bolt head (111) is shown. The bolt head (111) has, on both sides and symmetrical to one another, two slot-shaped recesses (110*a*, 110*b*), which run to the rear through a spring bore hole (197). An extractor hook (161) is inserted in one of the recesses (110*a*). A spring (not shown) in the associated spring bore hole (197) acts on the extractor hook (161) via a tappet. The extractor hook (161) can be pivoted around a vertical axis. A supporting body (199) is seated in the other recess (110*b*). The supporting body (199) is also mounted on a vertical axis. This supporting body (199) is similar to the extractor hook (161), but it is a bit larger, so that it cannot move in the recess (110*b*). Moreover, unlike the extractor hook (161), the supporting body (199) does not encompass the cartridge base of a cartridge (163) located in the cartridge chamber (103). To reverse the ejection direction, it is merely necessary to exchange the extractor hook (161) with the spring for the supporting body (199), and to change the ejector (not shown) from one side of the weapon to the other.

From the foregoing, persons of ordinary skill in the art will appreciate that semi-automatic rifles for large caliber shell cartridges with a long cartridge length and short cartridge case have been disclosed. The disclosed rifles are light and reload reliably. For example, a large caliber gas-operated rifle with a central force receiving part (104) that holds the rear end of a barrel (1) and the locking abutments of a breech is disclosed above.

A disclosed example rifle includes a gas intake opening (173) defined in the force receiving part (104) and in the barrel (101). A gas cylinder (171) is firmly joined with the force receiving part (104). The gas intake opening is in communication with the barrel (1) and the gas cylinder (171). Having the gas intake opening (173) in the force receiving part (104) makes a separate, power absorbing enclosure for the gas intake opening unnecessary. Furthermore, the gas intake opening (173) is placed far to the rear, where the gas pressure is sufficient for unlocking and operating even a heavy breech with a long reloading path.

In the illustrated example, the barrel (101) of the weapon is preferably provided, as is generally the practice, with a cartridge chamber (103) that is constructed in one piece with the barrel (101). However, it is also conceivable that the cartridge chamber (103) be separate from the barrel (101). As used herein, the term "barrel" includes the cartridge chamber (103), whether it is constructed in one piece with the barrel (101) or separate from the barrel (101).

In the illustrated example, the gas intake opening (173) is located near the front end of the cartridge chamber (103). The gas intake opening (173) is in communication with a bore hole in the force receiving part (104), which is, in turn, in communication with the front end of the gas cylinder (171). In the case of extremely large caliber rifles, the cartridge chamber (103) is often rather short compared with the caliber of the barrel (101). In the case of shell cartridges like those described above, the cartridge chamber (103) is extremely short. Thus, slow acceleration of the breech by the discharge gases is sufficient to ensure that the projectile has left the barrel prior to the opening of the breech. With large caliber rifles, the pressure decrease usually occurs so prematurely that the excess pressure in the barrel (101) is rather low when the projectile leaves the barrel (101). The illustrated example does not use a conventional pipe or similar component. The force receiving part (104) ensures that even a high pressure in its bore is harmlessly received and passed on to the gas cylinder (171). This gas cylinder (171) is preferably constructed in the force receiving part (104) and, consequently, does not require its own power absorbing component.

The bore (173) can extend diagonally either in the direction of fire or opposite the direction of fire in order to utilize or inhibit the kinetic energy of the discharge gases. Since the kinetic energy at the end of the chamber (103) is quite low, it is preferred that the bore hole (173) extends at a right angle to the direction of fire. This permits the force receiving part (104) to be kept as compact as possible.

The gas cylinder (171), which directly connects to the bore (173), can be seated laterally or underneath the cartridge chamber (103). However, in order to avoid excessively extending the width of the weapon and to be able to mount a magazine under the breech, it is preferred that the gas cylinder (171) be seated above the cartridge chamber (103). Constructing the gas cylinder (171) in the force receiving part (104) above the cartridge chamber enables a weapon style that is very stout, and that has a short length in the longitudinal direction.

The breech of the illustrated example is, as usual, formed from a bolt head (111) and a bolt head carrier (113). To make a regulator for the bolt head carrier (113) unnecessary, and to keep the style of the weapon short in spite of the gas cylinder (171) being located far in the rear, the bolt head carrier (113) of the illustrated example forms the gas piston.

Similar to a semi-automatic shotgun with a tube magazine, where the gas piston surrounds the magazine tube, in the illustrated example, it is preferred that a pipe (175) be firmly joined to the bolt head carrier (113); that the pipe (175) penetrates the gas cylinder (171); and that the pipe (175) emerges to the front of the force receiving part (104) as an attachment pipe (169) for a breech-closing spring. The inner surface of the gas cylinder (175) has an annular-shape. Moreover, the gas discharge force occurs precisely centrally on the bolt head carrier (113). The pull-back spring for the breech, (i.e., the so-called "breech-closing spring"), passes through the pipe (169), so that the bolt head carrier (113) forming the gas piston (175) can also be reset precisely centrally and, consequently, cannot jam. As a result, the diameter of the gas cylinder (171) can be built shorter than would otherwise be possible.

In some examples, the pipe (169, 175) carries a loading handle, which is either mounted to the pipe (169, 175) or can be attached or joined to it. This handle is used for reloading.

Persons of ordinary skill in the art will recognize that there are various conventional means of locking a breech. For example, lateral locking shutters or locking lugs mounted in a circle around the longitudinal center of the barrel are known. However, the shutters are applied off center, while lugs involve a backward motion of the bolt head, which increases the overall length of the rifle, even if only slightly. Therefore, in an illustrated example, a locking bolt (125) penetrates transversely through the bolt head (111) and is pressed into a safety position by the bolt head carrier (113) when the bolt head carrier (113) is in its resting position. When the locking bolt (125) is in the safety position, it engages in recesses (105, 106) of the force receiving part (104) and, as a result, it locks the bolt head (111). The recesses (105, 106) are advantageously disposed somewhat circular-symmetrically to the longitudinal axis of the barrel. To unlock the bolt head (111), the bolt head (111) does not have to travel an unlocking distance, but instead the locking block (25) is simply pulled out at a right angle to the longitudinal axis of the barrel (101). The device that move the locking block (125) can be located above the bolt head (111) and, thus, does not take up any overall length.

Preferably, a tilting lever (187) is provided to assist in the unlocking. The tilting lever (187) is arranged in the bolt head (111). One end of the tilting lever (187) engages in the path of motion of the bolt head carrier (113). The opposite end of the tilting lever (187) engages in the path of motion of the locking bolt (125). When the bolt head carrier (113) moves back, it rotates the tilting lever (187) to thereby pull the locking bolt (125) out of the recesses (105, 106) of the force receiving part (104). The tilting lever (187) is pivoted, for example, on a swiveling axis (189) which is transversely arranged in the bolt head (111). However, the tilting lever (187) may alternatively be replaced by a pressure spring which forces the locking bolt (125) out of the recesses (105, 106) when the bolt head carrier (113) has moved back sufficiently to permit the upper part of the locking bolt (125) to enter the coupling groove (191).

Additionally it is preferred that the locking bolt (125) engages in the bolt head carrier (113) when the locking bolt (125) is in the unlocked position so that the locking bolt (185) and the bolt head (111) move with the bolt head carrier (113). In the illustrated example, a positive connection is created between the bolt head (111) and the bolt head carrier (113) via the locking bolt (125), regardless of how quickly the bolt head carrier (113) moves rearward. Thus, for example, the positive connection is formed even in the case of slow reloading.

Preferably the locking bolt (125) defines an oblong hole (131) through which the firing pin (119) passes. The firing pin (119) has a bulge (129) behind the locking bolt (125). The oblong hole (131) has a beveled edge (133) to the rear, which engages on the bulge (129) of the firing pin (119) and pushes it back when the locking bolt (125) is pulled out of engagement with the recesses (105, 106) of the force receiving part (104), (i.e. when it is unlocked). Thus, after a shot, the firing pin (119) is forcefully pushed out of engagement with the cartridge (103) and cannot reach the cartridge base as long as the breech is unlocked. Consequently, a burst blasting cap (i.e., a so-called primer failure) cannot keep the firing pin (119) to the front, and a premature firing cannot take place when the bolt head (111) is not yet locked. This guarantees reliability and safety, even in the case of rare malfunctions.

Normally a bolt head (111) has only one extractor. However, providing two extractors is also known. As discussed in detail above, the illustrated bolt head (111) employs one extractor element (161) and one supporting element (199). In this example, there are two recesses (110*a*, 110*b*) in the bolt head (111) on opposite sides of the locking bolt (125). The rear of one of the recesses (110*b*) is in communication with a bore hole. The rear of the other one of the recesses (110*a*) is in communication with a bore hole for a set-bolt and a spring (197). An extractor (161) is located in one of the recesses (110*a*). The extractor (161) can be swiveled against the force of the spring as transferred by the set-bolt. A supporting element (199) is inserted in the opposite recess (110*b*). The supporting element (199) is located opposite the extractor (161), and laterally supports the base of a cartridge (163) or cartridge case (165). The extractor (161) and the supporting element (199) face one another.

The supporting element (199) supports the cartridge case (165) after the extraction, so that the cartridge case (165) does not slip from the opposing extractor hook (161). After the shot, the breech first undergoes an acceleration phase and then a deceleration phase. During the deceleration phase, the base of the accelerated cartridge case rests firmly on the breech block (181). The front area of the bolt head (111) is called the "breech block."

The spring, set-bolt and extractor (161) on one side and the supporting element (199) on the opposite side can, if desired, be exchanged to change the direction of cartridge ejection.

However, in the case of the shell cartridges discussed above, the cartridge case is very short. As a result, the shell case could possibly leave the cartridge chamber during the acceleration phase or shortly after the acceleration phase. Since the supporting element (199) and the extractor (161) are seated in recesses (110*a*, 110*b*) of the same type, they can be interchanged. In this manner, it is possible to rearrange the ejection direction of the rifle so that the rifle can be easily adapted to right-handed shooters or left-handed shooters.

Example gas pressurized loading devices are described in U.S. patent application Ser. No. 11/072,174, which is incorporated in its entirety herein by reference. Example cartridge ejection arrangements are described in U.S. patent application Ser. No. 11/072,765, which is hereby incorporated herein by reference in its entirety.

Although certain example, methods, apparatus and articles of manufacture have been described herein, the scope of coverage of this patent covers all methods, apparatus and articles of manufacture fairly falling within the scope of the appended claims either literally or under the doctrine of equivalents.

What is claimed is:

1. A firearm comprising:

a single force receiving component containing a gas cylinder;

a barrel in communication with a cartridge chamber received in the force receiving component, the cartridge chamber being in communication with a gas withdrawal opening and being sized to fire cartridges having a caliber of at least 15 mm;

a bore in communication with the gas withdrawal opening and the gas cylinder; and a locking bolt having a locked position and an unlocked position, the locking-bolt engaging the force receiving component when the locking bolt is in the locked position.

2. A firearm as defined in claim 1, wherein the gas withdrawal opening is located near a top of the cartridge chamber and the bore discharges into a front end of the gas cylinder.

3. A firearm as defined in claim 1, wherein the bore is oriented diagonal to a longitudinal axis of the barrel.

4. A firearm as defined in claim 1, wherein the gas cylinder is located above the cartridge chamber.

5. A firearm as defined in claim 1, further comprising a bolt head and a bolt head carrier, wherein the bolt head carrier includes a gas piston.

6. A firearm as defined in claim 5, further comprising a tube coupled to the bolt head carrier, the tube at least partially penetrating the gas cylinder and the tube being at least partially penetrated by a recoil spring.

7. A firearm as defined in claim 6, further comprising a loading handle coupled to the tube.

8. A firearm as defined in claim 5, wherein the locking bolt penetrates the bolt head and the locking bolt is moved by the bolt head carrier into the locked position where the locking bolt secures the bolt head against movement.

9. A firearm as defined in claim 8, further comprising a tipping lever having a first arm to engage the bolt head carrier and a second arm to engage the locking bolt, wherein the tipping lever forces the locking bolt from the locked position to the unlocked in response to a movement of the bolt head carrier.

10. A firearm as defined in claim 9, wherein the locking bolt engages in the bolt head carrier when the locking bolt is in the unlocked position so that the locking bolt and the bolt head are carried with the bolt head carrier over a portion of the motion path of the bolt head carrier.

11. A firearm as defined in claim 5, wherein the bolt head further comprises an extractor and a support element, the extractor and the support element being opposed to cooperatively secure a base of a cartridge or cartridge casing, the extractor being pivotably mounted to the bolt head, the support element being secured to the bolt head in a substantially immovable manner.

12. A firearm as defined in claim 5 wherein the locking bolt defines an oblong bore including a bevel, and further comprising a firing pin having a bulge, the firing pin freely penetrating the oblong bore when the locking bolt is in the locked position, the firing pin being moved to a withdrawn position by the interaction of the bevel and the bulge when the locking bolt is in the unlocked position.

13. A firearm comprising:

a central force receiving component containing a gas cylinder;

a barrel in communication with a cartridge chamber received in the force receiving component, the cartridge chamber being in communication with a gas withdrawal opening and being sized to fire cartridges having a caliber of at least 15 mm;

a bore in communication with the gas withdrawal opening and the gas cylinder;

a locking bolt having a locked position and an unlocked position, the locking-bolt engaging the force receiving component when the locking bolt is in the locked position;

a bolt head and a bolt head carrier, wherein the bolt head carrier includes a gas piston, wherein the locking bolt penetrates the bolt head and the locking bolt is moved by the bolt head carrier into the locked position where the locking bolt secures the bolt head against movement; and a tipping lever having a first arm to engage the bolt head carrier and a second arm to engage the locking bolt, wherein the tipping lever forces the locking bolt from the locked position to the unlocked in response to a movement of the bolt head carrier.

14. A firearm as defined in claim 13, wherein the locking bolt engages in the bolt head carrier when the locking bolt is in the unlocked position so that the locking bolt and the bolt head are carried with the bolt head carrier over a portion of the motion path of the bolt head carrier.

15. A firearm comprising:

a central force receiving component containing a gas cylinder;

a barrel in communication with a cartridge chamber received in the force receiving component, the cartridge chamber being in communication with a gas withdrawal opening and being sized to fire cartridges having a caliber of at least 15 mm;

a bore in communication with the gas withdrawal opening and the gas cylinder;

a locking bolt having a locked position and an unlocked position, the locking bolt engaging the force receiving component when the locking bolt is in the locked position, wherein the locking bolt defines an oblong bore including a bevel;

a firing pin having a bulge, the firing pin freely penetrating the oblong bore when the locking bolt is in the locked position, the firing pin being moved to a withdrawn position by the interaction of the bevel and the bulge when the locking bolt is in the unlocked position; and a bolt head and a bolt head carrier, wherein the bolt head carrier includes a gas piston.

* * * * *